US008430273B2

(12) United States Patent
Brouwer

(10) Patent No.: US 8,430,273 B2
(45) Date of Patent: Apr. 30, 2013

(54) DISPENSER UNIT WITH IMPROVED AIR SUPPLY

(75) Inventor: Markus Fransicus Brouwer, Heesch (NL)

(73) Assignee: MeadWestvaco Calmar Netherlands BV, Richmond, VA (US)

( * ) Notice: Subject to any disclaimer, the term of this patent is extended or adjusted under 35 U.S.C. 154(b) by 1014 days.

(21) Appl. No.: 12/092,039

(22) PCT Filed: Nov. 7, 2006

(86) PCT No.: PCT/NL2006/000559

§ 371 (c)(1),
(2), (4) Date: Jan. 26, 2009

(87) PCT Pub. No.: WO2007/053017

PCT Pub. Date: May 10, 2007

(65) Prior Publication Data

US 2011/0168739 A1 Jul. 14, 2011

(30) Foreign Application Priority Data

Nov. 7, 2005 (NL) ..... 1030361

(51) Int. Cl.
*B67D 7/76* (2010.01)

(52) U.S. Cl.
USPC ..... 222/190; 222/145.5; 222/321.7; 222/383.1

(58) Field of Classification Search ..... 222/190, 222/321.9, 145.5, 384, 145.6, 385, 321.7, 222/383.1
See application file for complete search history.

(56) References Cited

U.S. PATENT DOCUMENTS

| | | | | | |
|---|---|---|---|---|---|
| 5,271,530 | A * | 12/1993 | Uehira et al. | ..... | 222/190 |
| 5,289,952 | A * | 3/1994 | Gueret | ..... | 222/190 |
| 5,443,569 | A * | 8/1995 | Uehira et al. | ..... | 222/190 |
| 5,570,819 | A * | 11/1996 | Uehira et al. | ..... | 222/190 |
| 6,398,079 | B1 * | 6/2002 | Garcia et al. | ..... | 222/190 |
| 6,612,468 | B2 * | 9/2003 | Pritchett et al. | ..... | 222/190 |
| 6,840,408 | B1 * | 1/2005 | Foster et al. | ..... | 222/190 |
| 7,048,153 | B2 * | 5/2006 | Gentile | ..... | 222/190 |
| 7,147,133 | B2 * | 12/2006 | Brouwer et al. | ..... | 222/145.5 |
| 7,673,854 | B2 * | 3/2010 | Brouwer et al. | ..... | 261/28 |
| 7,726,518 | B2 * | 6/2010 | Brouwer | ..... | 222/145.6 |
| 2004/0069807 | A1 * | 4/2004 | Brouwer et al. | ..... | 222/175 |
| 2009/0212074 | A1 * | 8/2009 | Brouwer | ..... | 222/190 |

* cited by examiner

*Primary Examiner* — Frederick C. Nicolas
(74) *Attorney, Agent, or Firm* — MWV Intellectual Property Group

(57) ABSTRACT

The invention relates to a dispenser unit particularly suitable for a liquid container, including an air pump with an air cylinder and an air piston axially displaceable in the air cylinder, an air space defined between the air cylinder and the air piston, supply-closing structure for closing the air supply to the air pump, discharge-closing structure for closing the air discharge from the air pump, an axially displaceable activating element for activating the air pump, and an air inlet opening in the activating element, wherein the air inlet opening debouches in the air space, and at least a part of the air piston forms the supply-closing structure.

12 Claims, 8 Drawing Sheets

DISPENSER UNIT WITH IMPROVED AIR SUPPLY

TECHNICAL FIELD

The present invention relates to a dispenser unit particularly suitable for a liquid container, comprising an air pump with an air cylinder and an air piston axially displaceable in the air cylinder, an air space defined between the air cylinder and the air piston, supply-closing means for closing the air supply to the air pump, discharge-closing means for closing the air discharge from the air pump, an axially displaceable activating element for activating the air pump, and an air inlet opening in the activating element.

BACKGROUND

Such a dispenser unit is known from for instance WO 2004/069418. The dispenser unit shown herein is mounted on a liquid container by means of a threaded ring in order to obtain a foam pump. The activating element is formed by a cover with a spout-like dispensing part for dispensing foam. The activating element is movable relative to the liquid container. Product can be dispensed with the foam pump by pressing the activating element.

BRIEF SUMMARY OF THE INVENTION

The object of the present invention is to provide an improved dispenser unit.

The dispenser comprises for this purpose the feature that the air inlet opening debouches in the air space, and that at least a part of the air piston forms the supply-closing means. In this improved dispenser unit the functions of air piston and supply-closing means for the air pump are integrated into one structural component.

In a preferred embodiment said part of the air piston forms a moving part, in particular a moving part of a valve, of the supply-closing means, so that a separate valve part can be omitted.

The part of the air piston forming the supply-closing means is preferably arranged against the inner wall of the activating element and over the air inlet opening. The inner wall of the activating element forms the seat for the air inlet valve.

The air piston is advantageously movable in an axial direction for the purpose of forming the supply-closing means for air. The air inlet valve is opened or closed as a result of the axial movement the air piston performs.

The air piston is preferably movable axially relative to the activating element. In this manner an actively controllable air inlet valve is obtained.

The dispenser unit is further preferably provided with a liquid pump with a liquid cylinder and a liquid piston, wherein a liquid chamber is defined between the liquid cylinder and the liquid piston.

According to a further embodiment, the dispenser unit is further provided with an insert which is connected to the activating element and which comprises a mixing chamber for mixing air from the air pump and liquid from the liquid pump.

The liquid piston of the dispenser unit can then be movable in axial direction relative to the activating element or be fixedly connected to the activating element. When the liquid piston is axially movable relative to the activating element, discharge-closing means for air are hereby formed. The insert preferably forms, together with the liquid piston axially movable relative thereto, the discharge-closing means for air. In the other case, when the liquid piston is connected to the activating element, optionally via the above mentioned insert, the discharge-closing means comprise in a determined embodiment a pressure-controlled air outlet valve. In yet another embodiment, in which the activating element is coupled fixedly to the liquid piston, the discharge-closing means for air are formed by the activating element and the air piston.

According to a preferred embodiment of the invention, the air piston comprises a bottom edge part sealing the air cylinder, a top edge part sealing the air inlet opening, and a sleeve part extending substantially axially between the two edge parts. In addition, the activating element preferably comprises a cover with a spout-like dispensing part. The lower edge part of the cover can be displaced in axial direction over the inner wall of the air cylinder. The air and liquid pumps are operated during this displacement.

Finally, the present invention relates to a dispensing assembly comprising a liquid container and a dispenser unit according to the invention connected thereto.

BRIEF DESCRIPTION OF THE DRAWINGS

The invention will be further elucidated with reference to the accompanying drawings. In the drawings.

DETAILED DESCRIPTION OF THE INVENTION

Figure 1:
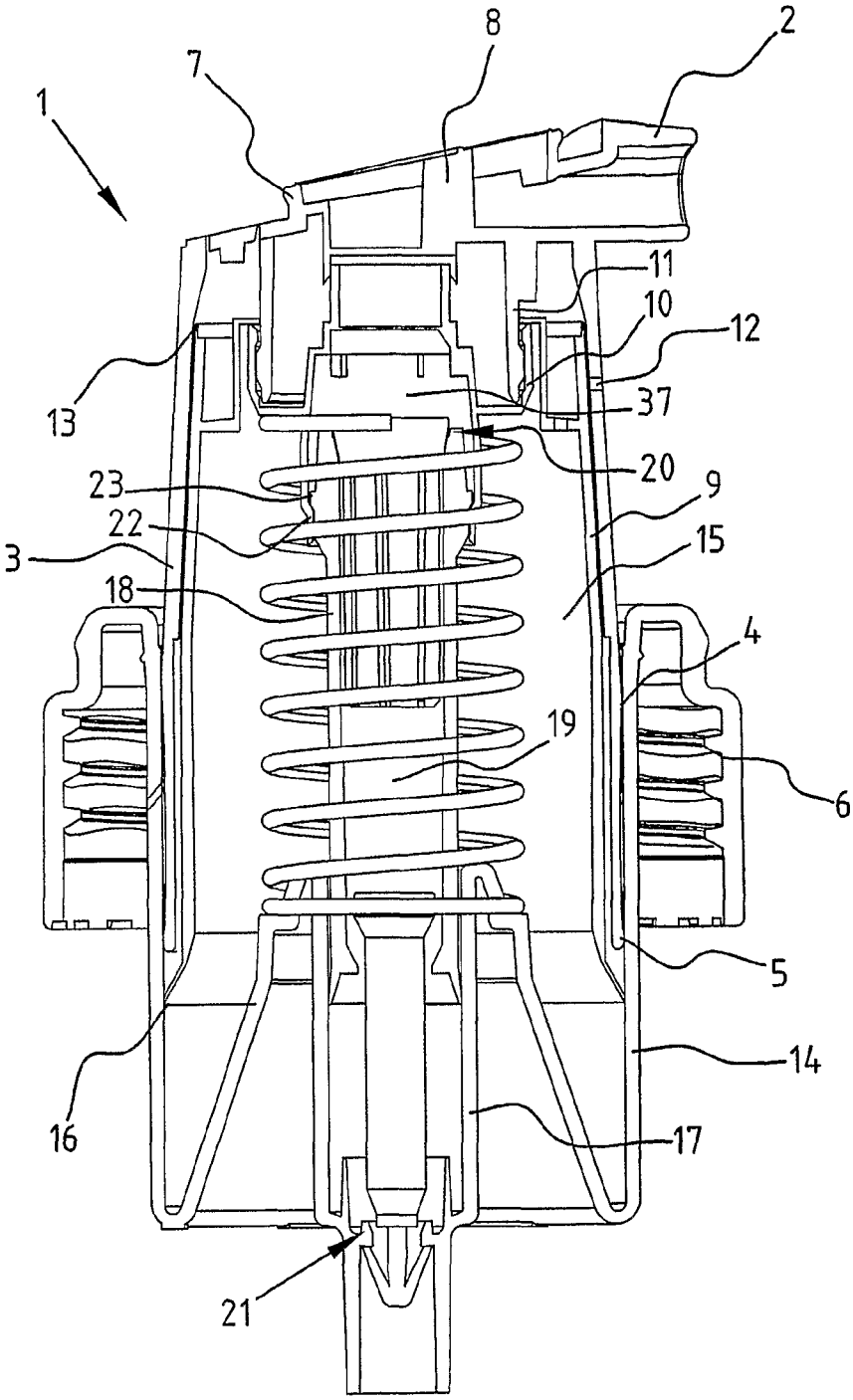
FIG. 1 shows a first exemplary embodiment of a dispenser unit according to the present invention in a rest position, without cover member.

Reference numeral 1 designates the cover which is provided with a spout-like dispensing part 2 and a casing 3. Casing 3 is provided on the underside with two peripheral edges 4, 5 with which it is in contact with the inner wall of a base part 6 of the dispenser unit. Base part 6 is provided with internal screw thread, by means of which the dispenser unit is screwed onto a liquid container.

An annular support edge 7 with partition wall 8 is situated on the top side of cover 1. A cover member (not shown) can be arranged on support edge 7. A foam-forming element can also be arranged. This element is in contact with partition wall 8 and the product for dispensing passes through this element twice on the way to spout-like dispensing part 2. A cover member which forms an engaging surface for operating the dispenser unit is arranged on top of cover 1, over support edge 7 and partition wall 8.

Reference numeral 9 designates an air piston which, according to the present invention, also serves as supply-closing means for closing the air-supplying air pump.

Finally, reference numeral 10 in FIG. 1 designates an insert. Insert 10 is snapped onto an internal wall 11 of cover 1. Insert 10 comprises a mixing chamber 37 for mixing air from the air pump and liquid from the liquid pump.

In addition, an air inlet opening 12 is arranged in casing 3 of cover 1. Air will enter the dispenser unit through this opening 12.

The dispenser unit further comprises an air pump with an air cylinder 14 and an air piston 9 axially displaceable on air cylinder 14, an air space 15 defined between the air cylinder and the air piston, supply-closing means for closing the air supply to the air pump and discharge-closing means for closing the air discharge from the air pump. The supply-closing means for closing the air supply to the air pump is formed by the upper edge part 13 of air piston 9, which can co-act with the inner wall of cover 1. Air inlet opening 12 debouches into air space 15. On the opposite side the lower edge part 16 of the air piston is always in sealing contact with air cylinder 14. Air piston 9 can be moved axially relative to cover 1. The air supply to the air pump is closed by pressing in the cover, since the upper edge part 13 of the air piston comes into contact with the inner wall of cover 1. When the cover is pressed in further, air space 15 will be made smaller and the air accommodated therein will therefore be compressed.

The dispenser unit is further provided with a liquid pump which comprises a liquid cylinder 17 and a liquid piston 18. A liquid chamber 19 is situated between liquid cylinder 17 and liquid piston 18. Reference numeral 20 designates the discharge-closing means for closing the liquid discharge from the liquid pump, while reference numeral 21 shows the supply-closing means for closing the liquid supply to the liquid pump. Liquid piston 18 can be moved in axial direction relative to cover 1 for the purpose of forming the discharge-closing means for air. These discharge-closing means for air are formed between bottom edge part 22 of insert 10 and a peripheral rib 23 close to the top side of air piston 18. The discharge-closing means for closing the air discharge from the air pump are actively operated by pressing in cover 1, whereby the insert co-displaces axially in the first instance, and liquid piston 18 will remain stationary. Contact between bottom edge part 22 and peripheral rib 23 is hereby broken, and the compressed air can leave air chamber 15 on the way to mixing chamber 37 (see FIG. 3). As cover 1 is pressed further in, liquid piston 18 will also be co-displaced so that the liquid in liquid chamber 19 is compressed and carried to mixing chamber 37 via the discharge-closing means for closing liquid discharge 20. During the return stroke air is drawn into air space 15 via opening 12, as shown in FIG. 2, due to the underpressure which is the result of air chamber 15 becoming larger and because upper edge part 13 of the air piston is wholly or partially released from the inner wall of the cover, and the air inlet is thereby opened.

The above-described preferred embodiment of the invention comprises an actively controllable air inlet valve mechanism and an actively controllable air outlet valve mechanism. Active is here understood to mean that the supply and discharge of air is controlled directly by displacement of one or more components of the dispenser unit. In the second embodiment to be described hereinbelow there is only an actively controllable air supply valve, while the air discharge is realized in passive manner (using a pressure difference-controlled valve mechanism). An actively controllable valve is also referred to as a "path-controlled" valve, wherein opening and closing takes place by displacing a component over a determined path or route. This in contrast a passively controlled or "pressure-controlled" valve, which is opened or closed as a result of a pressure difference.

Figure 4:
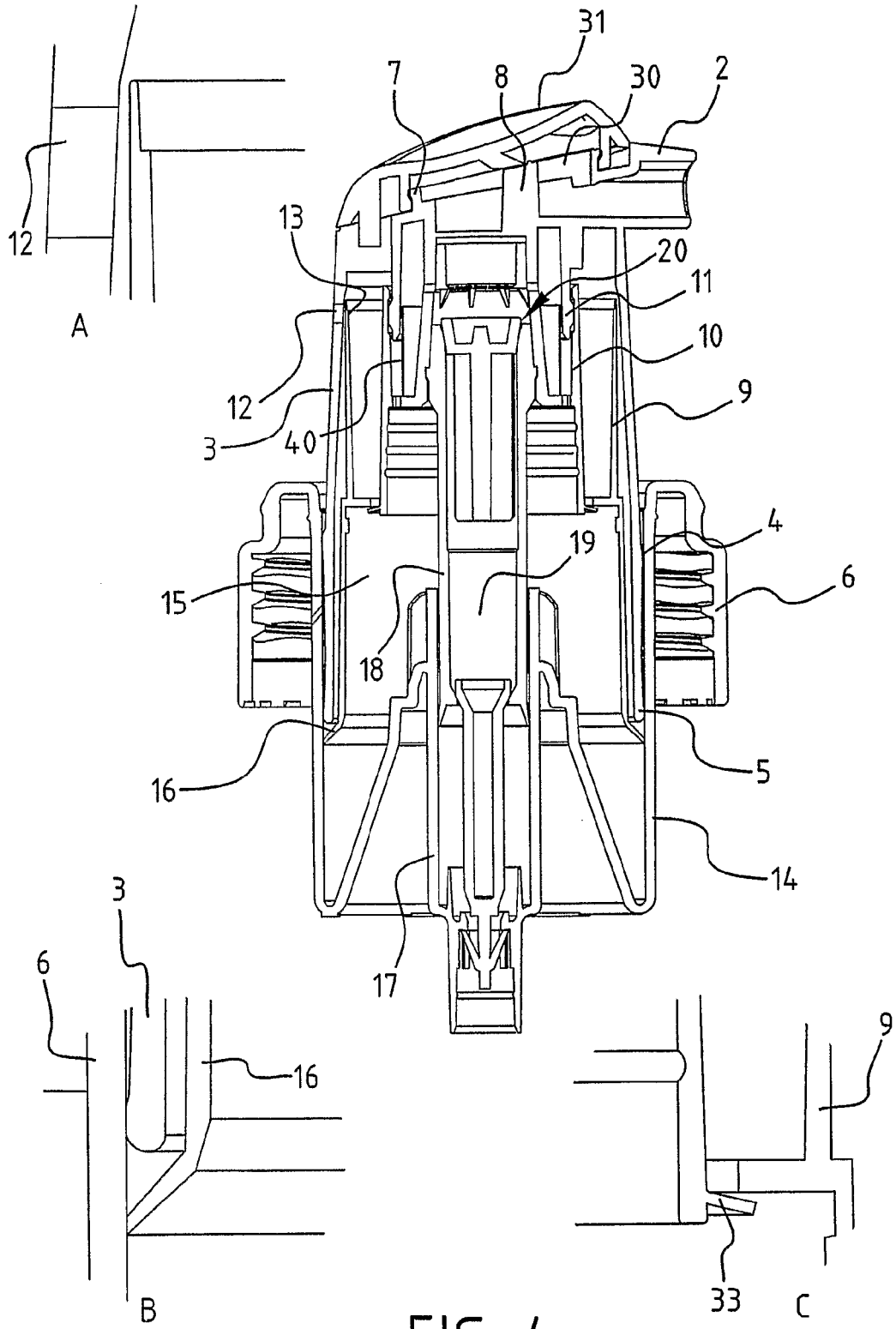
FIG. 4 shows a second exemplary embodiment of a dispenser unit according to the present invention in a rest position.
Figure 5:
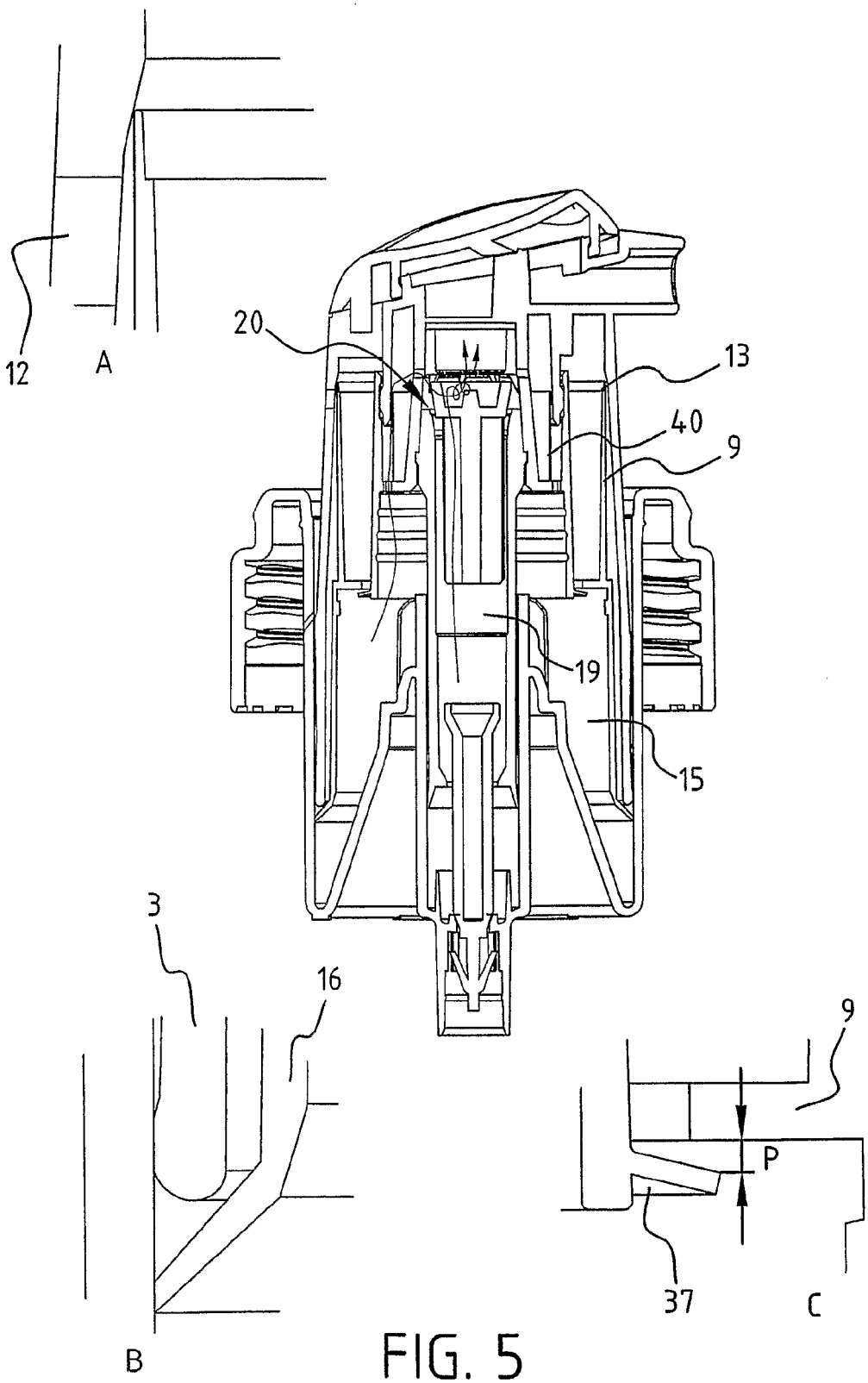
FIG. 5 shows the dispenser unit of FIG. 4 in a position during a downward stroke.
Figure 6:
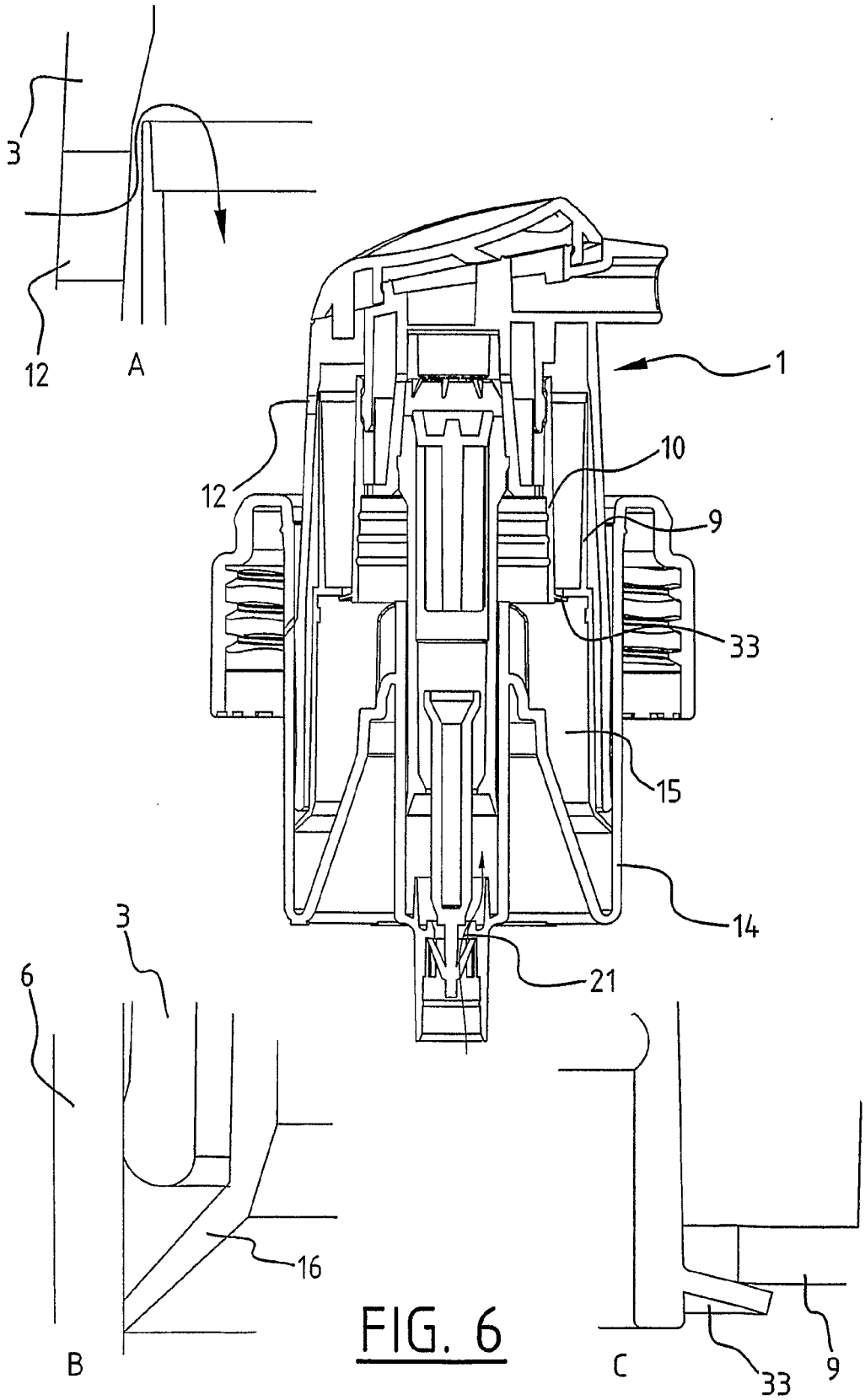
FIG. 6 shows the dispenser unit of FIG. 4 in a position during an upward stroke.

In the second exemplary embodiment shown in FIGS. 4-6 the construction of the dispenser unit is largely the same, and essentially identical components, or at least components with substantially the same function, are therefore designated with the same reference numerals. It is otherwise noted that cover member 31 is shown in FIGS. 4-6. It can also be seen that the above mentioned foam-forming element 30 is passed through twice.

Figure 2:
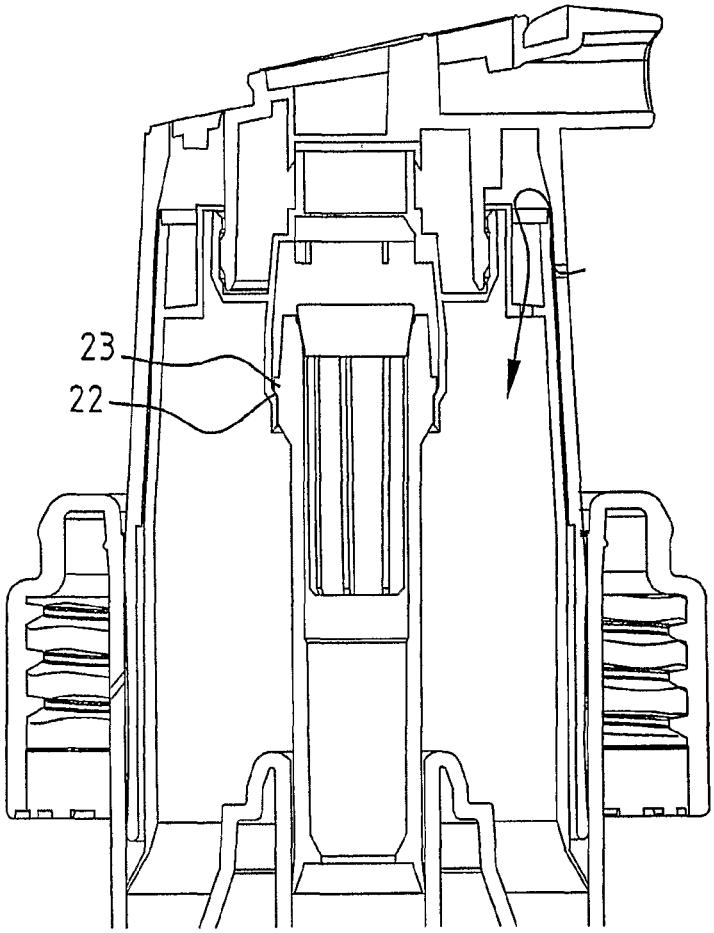
FIG. 2 shows the dispenser unit of FIG. 1 in extreme position during a return stroke.
Figure 3:
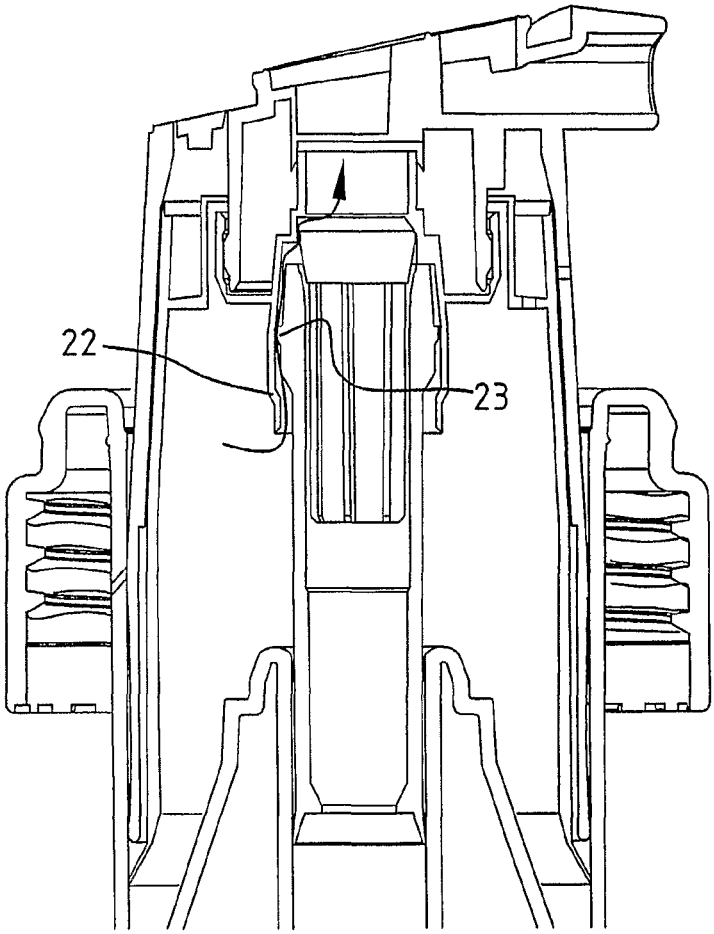
FIG. 3 shows the dispenser unit of FIG. 1 in extreme position during a downward stroke.

The main difference from the embodiment shown in FIGS. 1-3 is that here the liquid piston 18 is snapped fixedly into insert 10. The cover, the insert and the liquid piston therefore move axially up and downward as an assembly during operation. The discharge-closing means for closing the air discharge from the air pump are formed in this exemplary embodiment by a pressure-controlled pressure valve 40.

During the downward stroke the supply-closing means for the air supply are first closed when cover 1 is pressed because the stationary air piston 9 comes into contact with upper edge part 13 thereof against the inner wall of the axially displacing cover 1, as shown in respective details A at top left in FIGS. 4 and 5. In the situation shown in FIG. 5 the air inlet is closed. Air in air chamber 15 can be compressed hereon when the cover is pressed further in. The liquid piston is co-displaced in axial direction right from the start because it is connected to the cover. The liquid in liquid chamber 19 is therefore directly compressed. When a determined pressure difference is reached over pressure valve 40 for the air and discharge-closing means 20 for the liquid, these will open and the air and the liquid will move to mixing chamber 37 and there be mixed with each other (see FIG. 5).

When cover 1 is released the assembly can move upward again. In this embodiment this takes place under the influence of a spring (not shown) similar to the spring shown in FIG. 1. The cover will first move clear of air piston 9 so that the supply-closing means for closing the air supply to the air pump are opened. Due to the underpressure in air chamber 15 air from outside will be drawn directly into air chamber 15 through air inlet opening 12 via the open suction valve. Liquid suction valve 21 is also opened. At the start of the upward movement there is some play (p) between peripheral rib 33 on the underside of insert 10 (FIG. 5, detail C at bottom right) and a stop edge of air piston 9. As cover 1 and the insert 10 mounted thereon move back further, the peripheral rib comes to lie against said stop edge of air piston 9 (FIG. 6, detail C). Peripheral rib 33 then ensures that air piston 9 is co-displaced in a further return movement of cover 1. Return of the assembly to the starting position shown in FIG. 4 is provided by a spring which is not shown in FIGS. 4-6, but which is arranged between base part 14 and insert 10 as according to the embodiment of FIG. 1.

Figure 7:
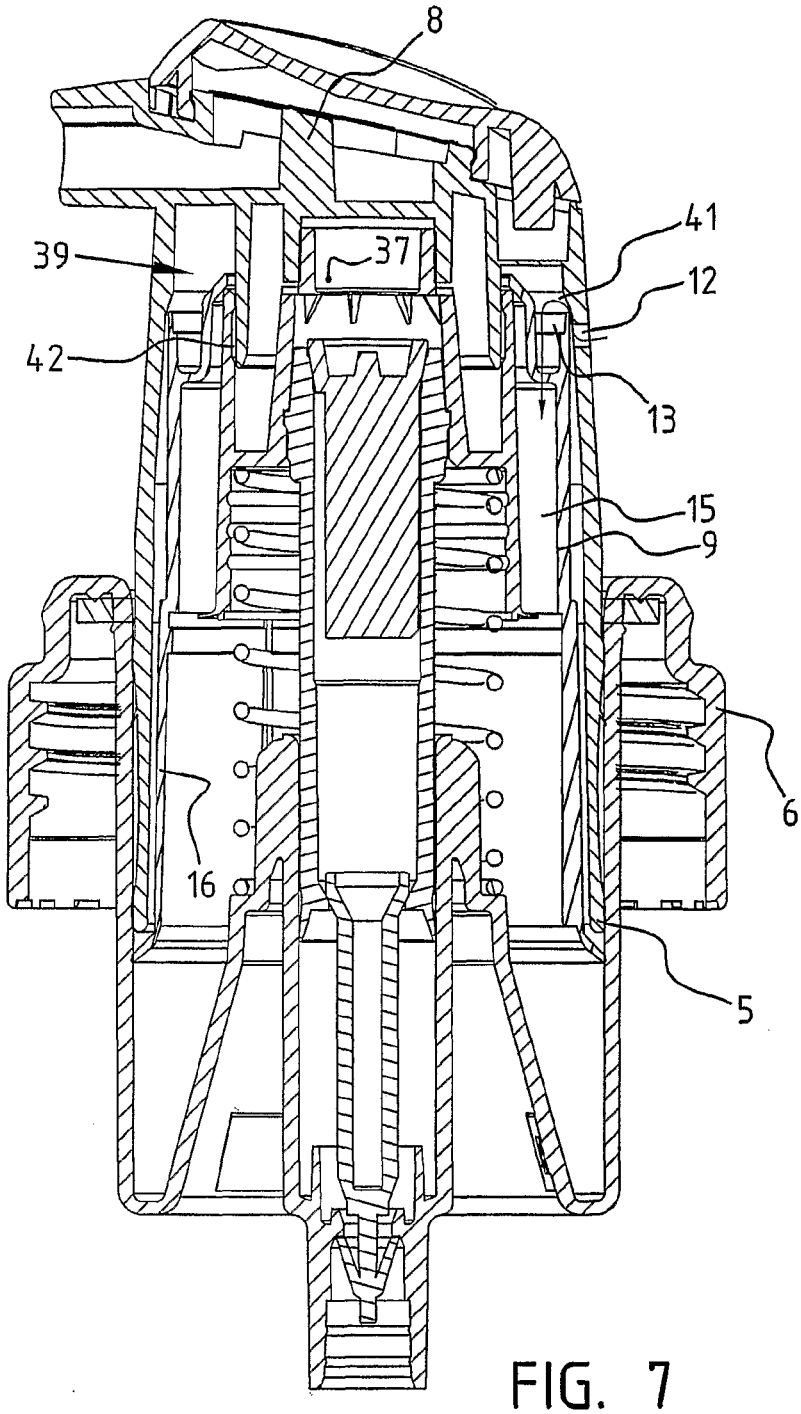
FIG. 7 shows a third embodiment of a double-acting dispenser unit according to the present invention in a rest position.
Figure 8:
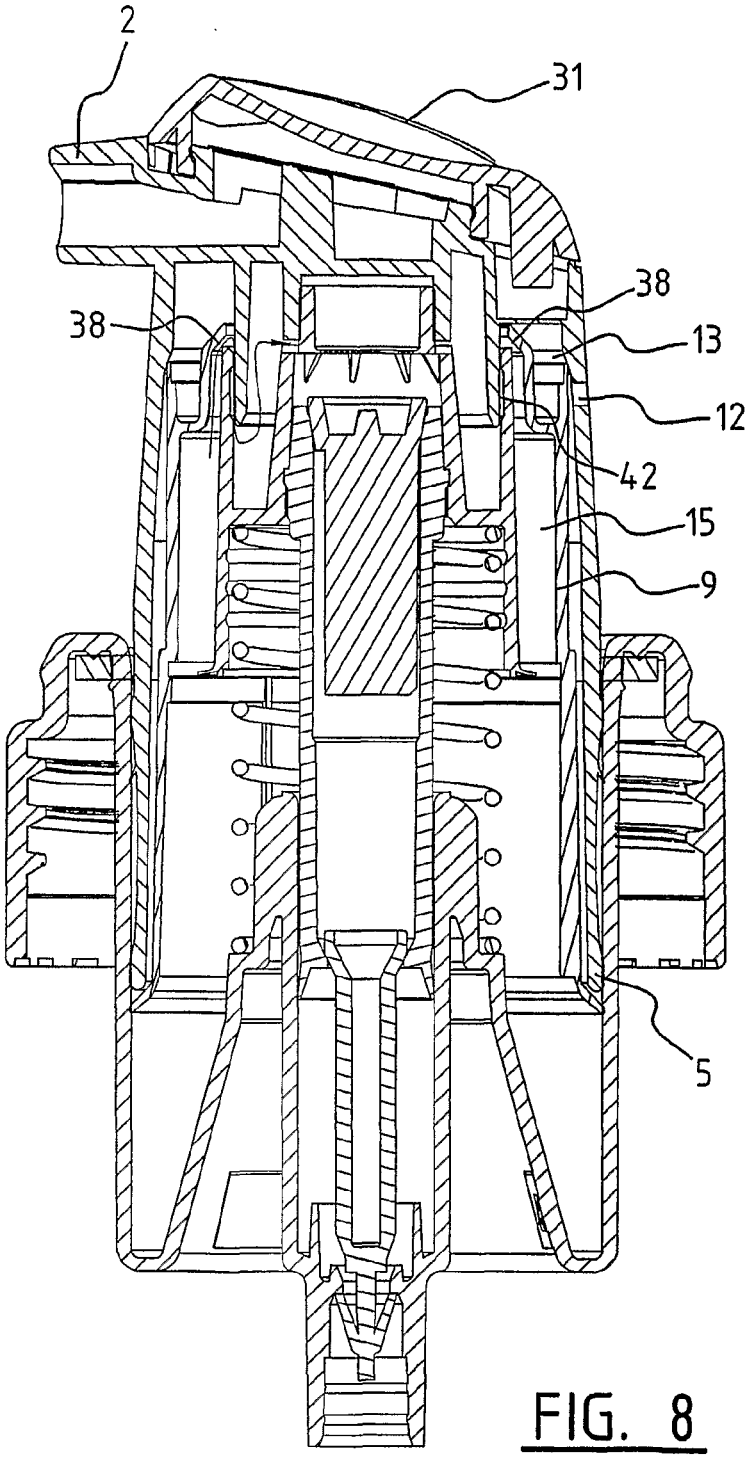
FIG. 8 shows the embodiment of FIG. 7 during the downward stroke.

FIGS. 7 and 8 show a third embodiment of a dispenser unit according to the invention. This embodiment once again relates to a dispenser unit. The shown construction of the dispenser unit is largely the same as the second embodiment of the invention shown in FIGS. 4-6, and essentially identical components, or at least components with substantially the same function, are therefore designated with the same reference numerals. As in the second embodiment, the liquid piston of the dispenser unit is also fixedly connected to the activating element in the third embodiment. While the discharge-closing means for air from the air chamber comprise in the second embodiment a passively controlled (more specifically, a pressure-controlled) pressure valve 40, in the third preferred embodiment these discharge-closing means 39 are actively controllable. The third embodiment hereby provides a double-acting dispenser unit.

FIG. 7 shows the position in which there is a gap 41 between upper edge part 13 of air piston 9 and the inner wall of cover 1. Air can therefore flow into air chamber 15 via air inlet opening 12 and said gap 41, this being shown in FIG. 7 with an arrow. During a downward movement of the activating element the upper edge part of air piston 9 comes to rest against the inner wall of cover 1 and thereby closes the air supply. This position is shown in FIG. 8. This figure also shows that air from air chamber 15 enters mixing chamber 37 via an opening 38 created between air piston 9 and insert 10 and via slots or channels 42.

The present invention is not limited to the above-described preferred embodiments thereof. The rights sought are rather defined by the following claims, within the scope of which many modifications can be envisaged.

The invention claimed is:

1. Dispenser unit suitable for a liquid container, comprising:

an air pump with an air cylinder and an air piston axially displaceable in the air cylinder, an air space defined between the air cylinder and the air piston, supply-closing means for closing an air supply to the air pump, discharge-closing means for closing an air discharge from the air pump, an axially displaceable activating element for activating the air pump, and an air inlet opening in the activating element, wherein the air inlet opening debouches in the air space, characterized in that at least a part of the air piston forms the supply-closing means, said part being arranged against the inner wall of the activating element and over the air inlet opening, wherein the air piston is movable axially relative to the activating element;

a liquid pump with a liquid cylinder and a liquid piston, wherein a liquid chamber is defined between the liquid cylinder and the liquid piston; and an insert which is connected to the activating element and which comprises a mixing chamber for mixing air from the air pump and liquid from the liquid pump.

2. Dispenser unit as claimed in claim 1, wherein said part of the air piston forms a moving part of the supply-closing means.

3. Dispenser unit as claimed in any one of claim 1 or 2, wherein the liquid piston is movable in axial direction relative to the activating element for the purpose of forming the discharge-closing means for air.

4. Dispenser unit as claimed in claim 3, wherein the insert forms, together with the liquid piston axially movable relative thereto, the discharge-closing means for air.

5. Dispenser unit as claimed in any one of claim 1, 2, 3, or 4, wherein the liquid piston is connected to the activating element.

6. Dispenser unit as claimed in claim 5, wherein the discharge-closing means comprise a pressure-controlled valve.

7. Dispenser unit as claimed in any one of the claim 1, 2, 3, 4, 5, or 6, wherein the air piston comprises a bottom edge part sealing the air cylinder, a top edge part sealing the air inlet opening, and a sleeve part extending substantially axially between the two edge parts.

8. Dispenser unit as claimed in any one of claim 1, 2, 3, 4, 5, 6, or 7, wherein the activating element comprises a cover with a spout-like dispensing part.

9. Dispenser unit suitable for a liquid container, comprising:

an air pump with an air cylinder and an air piston axially displaceable in the air cylinder, an air space defined between the air cylinder and the air piston, supply-closing means for closing an air supply to the air pump, discharge-closing means for closing an air discharge from the air pump, an axially displaceable activating element for activating the air pump, and an air inlet opening in the activating element, wherein the air inlet opening debouches in the air space, characterized in that at least a part of the air piston forms the supply-closing means, said part being arranged against the inner wall of the activating element and over the air inlet opening, wherein the air piston is movable axially relative to the activating element, wherein opening and closing of the air supply with the supply-closing means and/or of the air discharge with the discharge-closing means is performed in actively controllable manner.

10. Dispenser unit as claimed in any one of the claim 1, 2, 3, 4, 5, 6, 7, 8, or 9, wherein the supply-closing means and/or the discharge-closing means comprise path-controlled valves.

11. Dispensing assembly comprising a liquid container and a dispenser unit as claimed in any one of the claim 1, 2, 3, 4, 5, 6, 7, 8, 9, or 10 connected thereto.

12. Use of a dispenser unit or dispensing assembly as claimed in any one of claim 1, 2, 3, 4, 5, 6, 7, 8, 9, 10, or 11.

* * * * *